US005299802A

United States Patent [19]

Bouchet-Lassale

[11] Patent Number: 5,299,802

[45] Date of Patent: Apr. 5, 1994

[54] REMOVABLE GOLF CLUB GRIP

[76] Inventor: Jean Bouchet-Lassale, 4, avenue Calas, 1206 Geneva, Switzerland

[21] Appl. No.: 922,932

[22] Filed: Jul. 31, 1992

[30] Foreign Application Priority Data

Sep. 9, 1991 [CH] Switzerland ..... 02638/91

[51] Int. Cl.[5] ..... A63B 53/14

[52] U.S. Cl. ..... 273/81.4; 273/81.2; 273/81 D; 273/165; 273/DIG. 30

[58] Field of Search ..... 273/81 R, 81 D, 165, 273/81.2, 81.4, 81.5, 81.6, 75, 73 R, 73 J, 67 R, DIG. 30

[56] References Cited

U.S. PATENT DOCUMENTS

| | | | |
|---|---|---|---|
| 1,075,054 | 10/1913 | Morley | 273/165 |
| 1,573,612 | 2/1926 | Johnston | 273/165 |
| 1,664,257 | 3/1928 | McCullough . | |
| 1,843,039 | 1/1932 | Mohr | 273/165 |
| 1,942,922 | 1/1934 | Gerow | 273/165 |
| 2,484,762 | 10/1949 | Strazza | 273/165 |
| 2,628,100 | 2/1953 | Beebe | 273/81.4 |
| 3,111,322 | 11/1963 | English | 273/81.4 |
| 4,861,034 | 8/1989 | Lee | 273/81.2 X |
| 4,869,511 | 9/1989 | Spoonster, Sr. . | |
| 4,878,667 | 11/1989 | Tosti . | |
| 4,934,024 | 6/1990 | Sexton, I . | |

FOREIGN PATENT DOCUMENTS

| | | | |
|---|---|---|---|
| 2589743 | 5/1987 | France . | |
| 2133294 | 7/1984 | United Kingdom | 273/73 J |
| 2169839 | 7/1986 | United Kingdom . | |

*Primary Examiner*—Mark S. Graham
*Assistant Examiner*—Raleigh W. Chiu

[57] ABSTRACT

A removable grip adapted to be fixed on the existing conventional grip of a golf club is provided with hollows and protuberances enabling the player to adopt automatically a correct position of the hands on the grip.

15 Claims, 2 Drawing Sheets

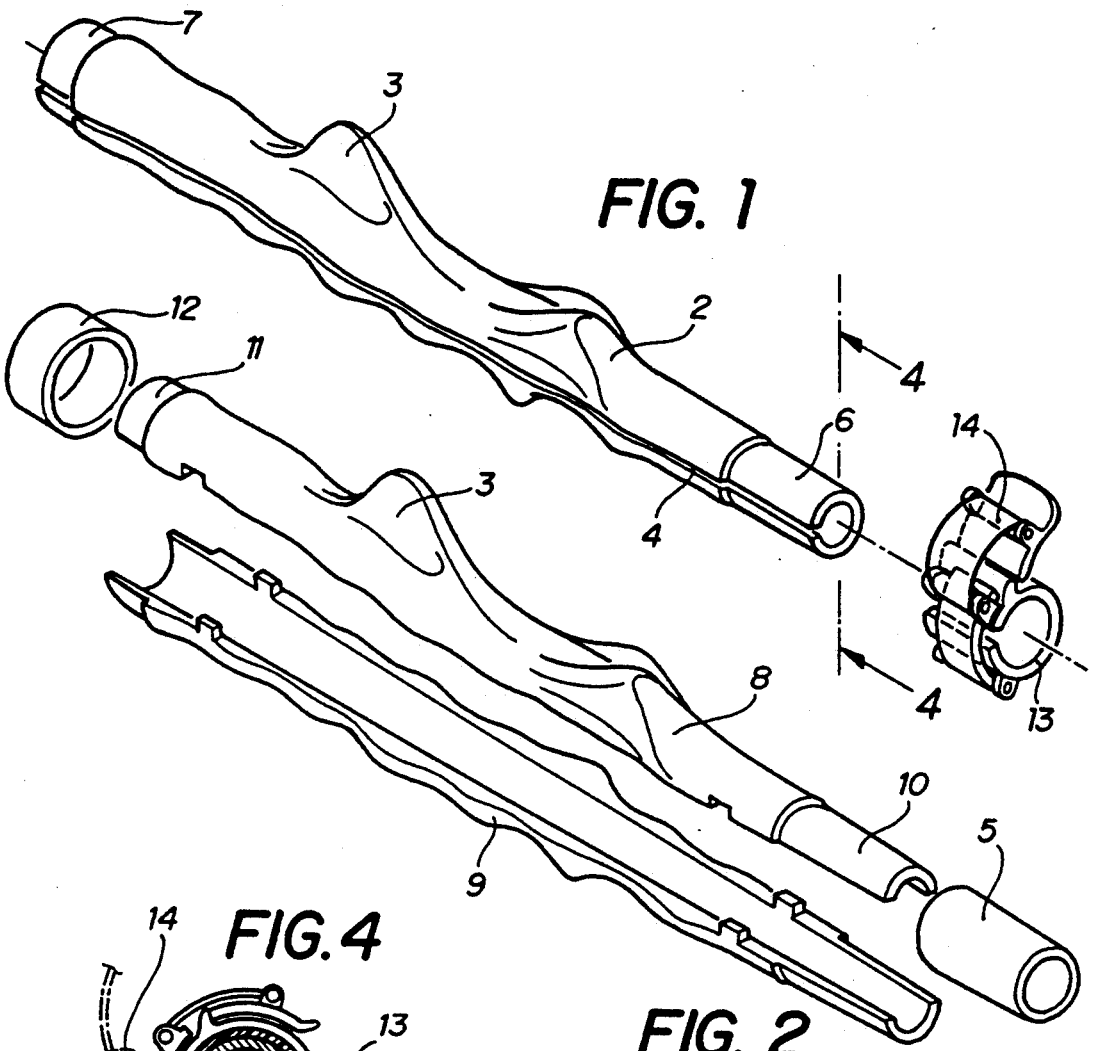
FIG. 1
FIG. 2
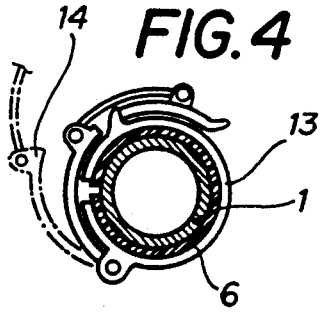
FIG. 4
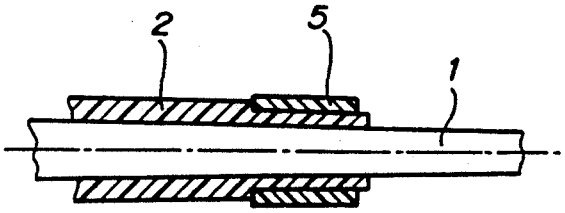
FIG. 3

REMOVABLE GOLF CLUB GRIP

BACKGROUND OF THE INVENTION

The present invention relates to a removable grip which can be fitted to existing golf club grips, according to the preamble of claim 1, and which in particular is adapted to the correct position of the fingers of the two hands of the player addressing the ball, that is to say when the hands are holding a golf club during the preparation and execution of the swing.

In known manner golf clubs have a heavy end provided with a face for striking the ball, a shaft of variable diameter which ends in a handle, generally covered with a nonslip material and sometimes marked with a reference line extending from the bottom end of the nonslip material to the end of the club remote from the heavy end.

It is known that instructors of this sport use in their equipment a utensil which is useful to beginners, but only to beginners, this utensil comprising a handle or grip provided with hollows corresponding to the optimum positions of the fingers of the two hands and, in a complementary arrangement, with protuberances corresponding to the gaps between fingers and hereinafter referred to as ribs.

These utensils are used only during the very early lessons, and the instructor quickly passes to so-called practice exercises performed with real clubs having a conventional grip consisting of a handle covered with a nonslip material, followed by exercises on a real course.

This entails disadvantages for novice players:

too brief or incomplete apprenticeship in the correct positioning of the fingers, the acquirement of bad habits once the first lessons have been forgotten or are imperfectly assimilated, a consequent deterioration of performance with all clubs having a conventional grip consisting of a handle covered with a nonslip material.

The document U.S. Pat. No. 1,664,257 (McCullough) describes a process for converting a golf club having a normal smooth grip into a grip having hollows and ribs adapted to the position of the fingers. Nevertheless, this process necessitates the sacrificing of a club in order to replace the grip definitively, which is a disadvantage. Removable golf club grips fitted over a smooth grip, such as that described in the documents U.S. Pat. Nos. 4,869,511 or 4,878,667, serve other purposes, such as for example increasing the weight of the grip or protecting it, and do not contribute towards better positioning of the fingers.

BRIEF SUMMARY OF THE INVENTION

The invention proposes to obviate these disadvantages by the means described in claim 1.

The adding to a conventional golf club grip of an additional, removable grip having hollows and ribs suitable for the automatic assumption of a correct position by the player addressing the ball enables the player, without any effort of memory, to retain the position learned during the first lessons until he finally acquires correct habits for the positioning of the hands on the conventional golf club grip, either with or without the removable grip forming the subject of the present invention.

It is clear that the advantage of the invention is, in particular, the definitive long-term improvement of the player's performance, and also, for the player, a reduction of the cost of lessons and, for the instructor, a saving of time and instructional effort.

The increase of the diameter of the grip resulting from the addition of the removable grip forming the subject of the invention has no disadvantage from the point of view of the comfort of the player.

Other forms of construction are described in the claims accompanying the present application.

Various models for the shape of the removable grip may be provided, each adapted to the size, sex, laterality and, more generally, to the physiological parameters of the player which affect the shape of the hands and their position on the grip.

Provision may be made for the use of a semirigid plastic material for the removable grip forming the subject of the invention, so that it can be suitably applied over the conventional grip if the latter has a variable diameter; for this purpose the inside diameter of the removable grip may be slightly smaller than the outside diameter of the existing conventional grip.

The removable grip according to the invention may preferably be made in two forms:

in a single piece, provided with a longitudinal slit along the reference line and able to be opened sufficiently to be clipped onto the part of the club where the shaft has the smallest diameter, thereupon, with the slit still held open, being brought by sliding to the position intended for the removable grip on the existing conventional grip;

in two parts constituting two half-shells, optionally joined together at their ends by a flexible or pivoting joint, or otherwise provided with studs to ensure correct positioning of each half-shell in relation to the other and optionally in relation to the existing conventional grip. In this embodiment of the invention the removable grip is placed in position directly on the existing conventional grip without it being necessary to fit it onto the part of the club shaft which has the smallest diameter.

In both embodiments of the invention the removable grip is secured to the existing conventional grip, in such a manner as to prevent any relative movement in relation to said existing conventional grip, by fastening means known per se.

Such fastening means may in particular be a system in which a VELCRO (synthetic materials which adhere when pressed together) band, fixed at one end to the removable grip, for example at the bottom, can be wound around the assembly comprising the existing conventional grip and the removable grip, once the latter has been placed in position, These means may also make use of fastening with the aid of clamps similar to those used for ski boot fasteners, of which details will be given below.

This system of fastening by means of clamps consists of a device in which a tongue bears against a notch and which, when closed by a simple movement of the hand, enables a certain pressure to be applied to the part around which this device is fitted.

This pressure may be variable, as in the case of ski boot fasteners, which in known manner permit adjustment of the fastening of the boot with the aid of a plurality of notches.

The pressure may also be invariable where there are only one tongue and one notch against which the tongue bears. Another known fastening means making use of the same principle with a single fastening position, without adjustability, is the mechanism used for closing hermetic containers, such as water bottles for travelling or preserve jars, by the compression of an elastic washer between a lid and the container.

In one particular embodiment of the invention the removable grip will be in one piece, with a longitudinal slit, together with a single clamp gripping its bottom part once it has been placed in position on the handle.

Among other possible fastening means, mention may be made of hose clips or clam type cleats used in sailing boat rigging equipment.

It will be possible to choose for preference those means which take up little space in the fastened position, so as not to form undesirable projections on the club or to cause scratches on sensitive surfaces.

Another fastening means may consist of at least one ring, which optionally may be more or less conical and which is fitted over at least one end of the removable grip, its dimensions being such that the removable grip is gripped sufficiently tightly on the existing conventional grip to prevent any relative movement in relation to the existing conventional grip during the swing. This ring can be provided with an internal screwthread matching an external screwthread on the corresponding part or parts of the existing conventional grip, and may also be knurled to enable it to be tightened without a tool. This fastening means has the advantage of perfect symmetry in relation to the axis of the club, after it has been tightened, thus ensuring the absence of projecting parts.

In a special embodiment of the invention, comprising two half-shells, it will be possible to articulate the two half-shells to form a jaw intended to be closed over the existing conventional grip. In this way, by positioning the end of one of the half-shells against the end of the existing conventional grip, said half-shell forming a certain angle with the existing conventional grip, it is advantageous to be able to insert the end of the second half-shell into that of the first, over the same end of the existing conventional grip, and then to close the two half-shells on the existing conventional grip, and finally to bring a single clamping ring, previously threaded onto the shaft of the club by way of the existing conventional grip, into a position gripping the two still free ends of the two half-shells, which are thus secured in position against the existing conventional grip. It is obvious that the inside diameter of this ring must be greater than the maximum diameter of the existing conventional grip, which on conventional clubs is located at its end, in order to be able to thread it beforehand onto the shaft of the club.

It will also be possible to provide two rings, one gripping the ends of the two half-shells near the end of the existing conventional grip, and the other gripping the other two ends, as described above. This last-mentioned embodiment of the invention is illustrated in the drawings.

The advantages of the invention will be better understood by reference to the accompanying detailed drawings, in which:

BRIEF DESCRIPTION OF THE DRAWINGS

FIG. 1 is a view in perspective of an embodiment in a single piece, with the clamp ready to be threaded onto the bottom part;

FIG. 2 is a similar view of an embodiment comprising two half-shells and two securing rings;

FIG. 3 is a partial longitudinal section of one or the other of the two embodiments, fastening being effected with the ring 5, which is shown in the fastened position;

FIG. 4 is a view in cross-section on the line A—A of the club handle provided with the sleeve shown in FIG. 1, the clamp being fastened;

DETAILED DESCRIPTION OF THE INVENTION

Figure 5:
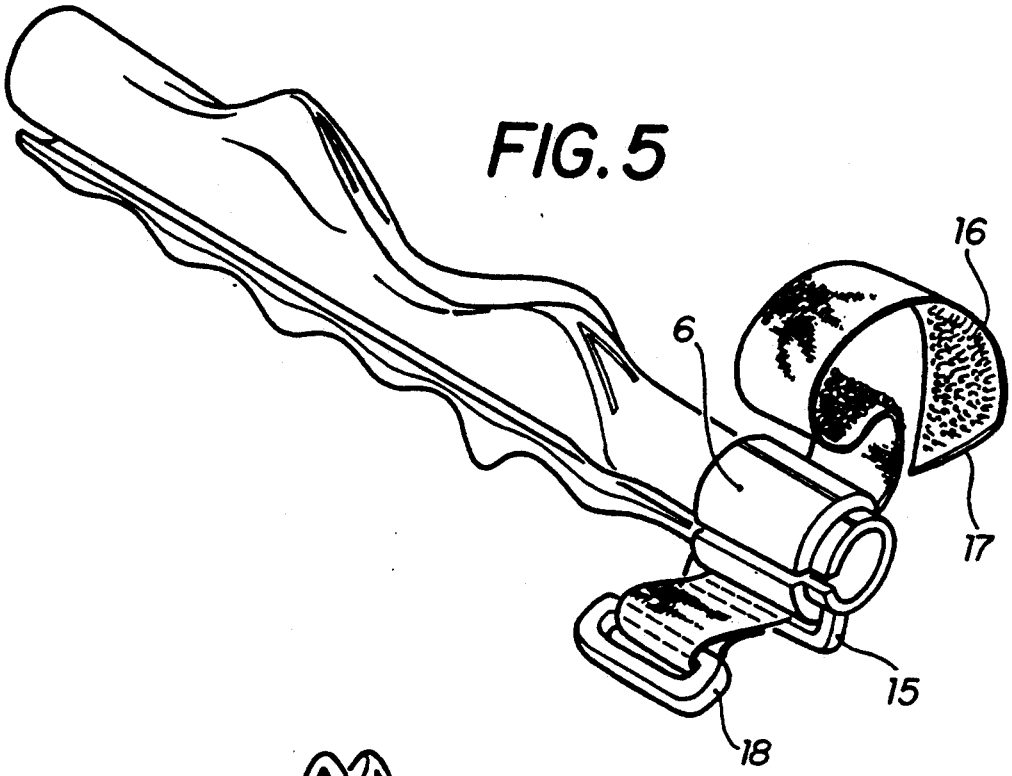
FIG. 5 shows the embodiment already shown in FIG. 1, but with a fastening system in the form of a VELCRO (synthetic materials which adhere when pressed together) band.

FIG. 1 shows an example of a removable grip 2 made in a single piece and provided with hollows or protuberances 3, and also with a slit 4 which will lie on the reference line of the existing conventional grip of the club. In the preferred embodiment, grip 2 is made of a semirigid plastic material.

At the bottom end of the removable grip 2, corresponding to the bottom end of the existing conventional grip, a part 6 is provided which has a smaller outside diameter, so as to be able to receive a clamp 13. The top end 7 is disposed at the end of the existing conventional grip.

FIG. 2 shows an example of a removable grip comprising two half-shells 8 and 9. The top half-shell 8 also has a bottom part 10 of smaller outside diameter. This bottom part 10, together with the corresponding part of the half-shell 9, receives the ring 5. In this example a top part 11 situated at the end of the existing conventional grip is secured on said end by means of the ring 12.

FIG. 3 shows in longitudinal section the removable grip 2 after mounting on the existing conventional grip 1 of the club. The ring 5 prevents any relative movement, particularly any rotation, between the detachable grip 2 and the existing conventional grip 1.

FIG. 4 shows in cross-section on the line A-A the existing conventional grip 1 of the club, on which in the closed position the clamp 13 holds the bottom part 6 shown in FIG. 1. The position 14 shows in broken lines the opening mechanism of the clamp 13.

FIG. 5 shows a removable grip made in a single piece and provided at its bottom end 6, which has a widened diameter, with a bow 15 through which is passed a VELCRO (synthetic materials which adhere when pressed together) band 16. One end 17 of said band is beveled to facilitate its insertion through a buckle 18 fastened to its other end. The length of the band 16 is substantially twice the circumference of the end 6, and is divided into two parts, the first of which, for example that nearer the buckle, being covered with the "vel" face of the VELCRO (synthetic materials which adhere when pressed together), consisting of closed loops, and the second, for example that on the side at the end 17, being covered with the same length of the "cro" face of the VELCRO (synthetic materials which adhere when pressed together, which consists of open hooks which will be gripped in the loops. In this way, when the removable grip is tightened by pulling the end 17 with the buckle 18 acting as purchase point, the entire circumference of the end 6 is covered with the "vel" face on which the "cro" face will become hooked over a new circumference turn.

Figure 6:
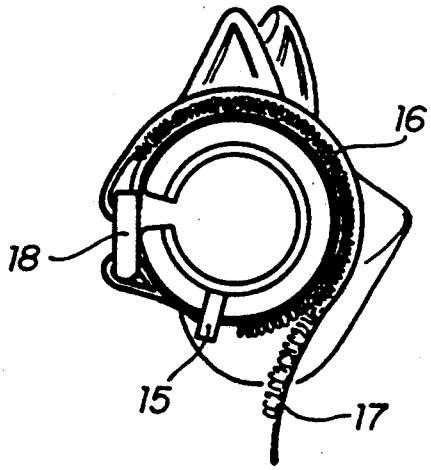
FIG. 6 shows the same embodiment as in FIG. 5, in a cross-sectional view.

FIG. 6 shows the removable grip secured on an existing conventional grip (not shown).

It is clearly understood that the invention is not restricted to the embodiments illustrated in the drawings.

What is claimed is:

1. A removable grip for use on a golf club grip to facilitate proper positioning of the hands, said removable grip being provided with means for converting said gold club grip into a grip having hollows and ribs corresponding to a correct position of the hands, and with means for releasably fastening said removable grip to said golf club grip, said fastening means being provided with a longitudinal slit enabling said removable grip to be opened in order to place said removable grip in position and to detach it, said fastening means fastening said removable grip to said golf club grip to prevent any relative movement in relation to said golf club grip.

2. The removable grip as claimed in claim 1, wherein the hollows and ribs are adapted to the physiological parameters of the player's hands.

3. The removable grip as claimed in claim 1, wherein in said removable grip is made of a semirigid plastic material.

4. The removable grip as claimed in claim 1, wherein the inside diameter of the removable grip is slightly smaller than the outside diameter of the existing conventional grip of the club.

5. The removable grip as claimed in claim 1, wherein the removable grip has a top part and bottom part and wherein the fastening means comprise rings which are placed over the bottom part and top part of the removable grip.

6. The removable grip as claimed in claim 1, wherein the fastening means comprise a VELCRO band which include a buckle and the fastening means is tightened by means of the buckle.

7. The removable grip as claimed in claim 1, wherein the fastening means comprise at least one clamp closure system provided with a lever.

8. A removable grip for use on a golf club grip to facilitate proper positioning of the hands, said removable grip being provided with means for converting said golf club grip into a golf club grip having hollows and ribs corresponding to a correct position of the hands, and with means for releasably fastening said removable grip to said golf club grip, said removable grip having two half-shells adapted to be placed over the golf club grip, said removable grip being fastened to said golf club grip to prevent any relative movement of said removable grip in relation to said golf club grip.

9. The removable grip as claimed in claim 8, wherein said removable grip is made of a semirigid plastic material.

10. The removable grip as claimed in claim 8, wherein the inside diameter of the removable grip is slightly smaller than the outside diameter of the golf club grip.

11. The removable grip as claimed in claim 8, wherein the removable grip has a top part and a bottom part and wherein the fastening means comprise rings which are placed over the bottom part and top part of the removable grip.

12. The removable grip as claimed in claim 8, wherein the fastening means comprise a VELCRO band which includes a buckle and the fastening means is tightened by means of the buckle.

13. The removable grip as claimed in claim 8, wherein the fastening means comprise at least one clamp closure system provided with a lever.

14. The removable grip as claimed in claim 8, wherein the hollows and ribs are adapted to the physiological parameters of the player's hands.

15. The removable grip as claimed in claim 8, wherein the two half-shells are articulated to form a jaw which closes over the golf club grip.

* * * * *

UNITED STATES PATENT AND TRADEMARK OFFICE

CERTIFICATE OF CORRECTION

PATENT NO. : 5,299,802
DATED : April 5, 1994
INVENTOR(S) : Jean Bouchet-Lassale

It is certified that error appears in the above-indentified patent and that said Letters Patent is hereby corrected as shown below:

Column 5, line 7, delete "gold" and insert --golf--

Column 5, line 33, delete "include" and insert --includes--

Signed and Sealed this

Twenty-sixth Day of July, 1994

*Attest:*

*Attesting Officer*

BRUCE LEHMAN

*Commissioner of Patents and Trademarks*